US007527691B2

(12) United States Patent
Ando et al.

(10) Patent No.: US 7,527,691 B2
(45) Date of Patent: May 5, 2009

(54) COATING APPARATUS AND COATING METHOD

(75) Inventors: Hiromu Ando, Shizuoka-ken (JP); Shin Kanke, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 638 days.

(21) Appl. No.: 10/759,129

(22) Filed: Jan. 20, 2004

(65) Prior Publication Data

US 2004/0144305 A1 Jul. 29, 2004

(30) Foreign Application Priority Data

Jan. 17, 2003 (JP) ..... 2003-008985
Feb. 3, 2003 (JP) ..... 2003-025390

(51) Int. Cl.
*B05C 1/00* (2006.01)

(52) U.S. Cl. ..... 118/223; 118/216; 118/414

(58) Field of Classification Search ..... 118/256, 118/412, 414, 216, 223, 225, 244, 258, 415, 118/410, 407, 419
See application file for complete search history.

(56) References Cited

U.S. PATENT DOCUMENTS 764,796 A * 7/1904 Davis ..... 118/252
2,066,780 A * 1/1937 Holt ..... 427/356
2,729,192 A * 1/1956 Warner ..... 118/117
3,084,663 A * 4/1963 Warner ..... 118/104
3,424,126 A * 1/1969 Mahoney ..... 118/63
4,102,299 A * 7/1978 Wallsten ..... 118/50
4,116,162 A 9/1978 Dinter et al.
4,263,870 A * 4/1981 Saito et al. ..... 118/259
4,456,637 A * 6/1984 Takeda et al. ..... 427/355
4,518,637 A 5/1985 Takeda et al.
4,521,459 A * 6/1985 Takeda ..... 427/359
4,869,933 A * 9/1989 Sollinger et al. ..... 427/356
5,083,527 A 1/1992 Naruse
5,599,393 A * 2/1997 Elvidge et al. ..... 118/117
5,665,163 A * 9/1997 Li et al. ..... 118/413
5,843,529 A * 12/1998 Peiffer ..... 427/348
5,858,090 A * 1/1999 Gottwald ..... 118/119
6,579,368 B1 6/2003 Kohl et al.
7,041,339 B2 5/2006 Kanke et al.

(Continued)

FOREIGN PATENT DOCUMENTS

GB 1 192 515 5/1970

(Continued)

*Primary Examiner*—Brenda A Lamb
(74) *Attorney, Agent, or Firm*—Sughrue Mion, PLLC

(57) ABSTRACT

Provided is a coating apparatus for coating with coating liquid a surface of a strip-shaped body carried in a fixed direction includes, a primary bar extending along a width direction of a carrying plane, which is a carrying path of the strip-shaped body, a secondary bar extending in parallel with and on the downstream side of the primary bar, and a between-bars liquid reservoir disposed between the primary and secondary bars for storing the coating liquid therein at the time of coating. Conditions are set so that relationship $W_2<W_1$ is formed between a coating amount $W_1$ of the coating liquid at the primary bar and a coating amount $W_2$ of the coating liquid after the strip-shaped body has passed through the secondary bar. A coating apparatus is also provided, in which the secondary bar contacts the strip-shaped body before the primary bar at the time of starting coating.

5 Claims, 14 Drawing Sheets

U.S. PATENT DOCUMENTS

| | | | | |
|---|---|---|---|---|
| 2003/0049379 | A1* | 3/2003 | Kanke et al. | 427/355 |
| 2003/0099769 | A1* | 5/2003 | Mandai et al. | 427/128 |
| 2004/0043154 | A1* | 3/2004 | Ichikawa et al. | 427/355 |

FOREIGN PATENT DOCUMENTS

| | | | | |
|---|---|---|---|---|
| JP | 58-004589 | B2 | | 1/1983 |
| JP | 2-45172 | | * | 3/1990 |
| JP | 6-007816 | Y2 | | 3/1994 |
| JP | 2002-192050 | | | 7/2002 |
| JP | 2002-224608 | | | 8/2002 |
| JP | 2003-53245 | | * | 2/2003 |
| JP | 2003-053245 | | | 2/2003 |
| JP | 2003-103212 | | | 4/2003 |
| JP | 2003-275642 | | * | 9/2003 |

* cited by examiner

COATING APPARATUS AND COATING METHOD

CROSS-REFERENCE TO RELATED APPLICATIONS

This application claims priority under 35 USC 119 from Japanese Patent Application Nos. 2003-8985 and 2003-25390, the disclosures of which are incorporated by reference herein.

BACKGROUND OF THE INVENTION

1. Field of the Invention

The present invention relates to a coating apparatus and a coating method, and specifically, to a coating apparatus and a coating method capable of performing coating stably in a broad range of coating conditions and inhibiting the occurrence of product failures, and a coating apparatus and a coating method capable of inhibiting the occurrence of product loss at the time of starting coating.

2. Description of the Related Art

A planographic printing plate precursor is manufactured generally by forming a support web by graining at least one surface of an aluminum web made of pure aluminum or aluminum alloy and forming anodic oxide coating on the surface if necessary, and then, by coating the grained surface of the support web with plate-making layer forming liquid such as photosensitive layer forming liquid and heat sensitive layer forming liquid and drying it to form a photosensitive or heat sensitive plate-making surface.

A bar coater is generally used for coating a strip-shaped body such as the support web with the coating liquid such as the plate-making layer forming liquid.

As the bar coater, conventionally, a bar coater has been generally used, which has a bar that rotates in the same direction as or opposite direction to a running direction of the web while being in contact with an under surface of the continuously running web, and a coating part that forms a coating liquid reservoir by discharging coating liquid on the upstream side of the bar in relation to the running direction of the web (hereinafter, referred to as just "upstream side"), and coats the under surface of the web with the coating liquid at the time of running of the web.

As the bar coater, a bar coater (Japanese Utility Model Registration No. 2,054,836) has been generally used, which has a first sheathing board provided close to the bar on the upstream side of the bar and formed so that the thickness of the upper end thereof is thinner toward the downstream side in relation to the running direction of the web (hereinafter, referred to as just "downstream side"), the upper end of the first sheathing board being bent toward the bar, and a flat surface having a length of 0.1 to 1 mm on the top thereof. A bar coater (Japanese Patent Application Publication (JP-B) No. 58-004589) has been also used, which has a first sheathing board formed so that the thickness of the upper end thereof is thinner toward the downstream side, a bar, and a second sheathing board provided on the downstream side of the bar.

However, when the running speed of the support web is increased, an entrained air film as a film of air running while accompanying the support web, i.e., entrained air tends to be formed on the surface of the support web.

In both of the bar coaters, there is a problem that, when the entrained air film is formed on the surface of the support web, since the entrained air film is introduced into the coating liquid reservoir, the coating liquid becomes prevented from being deposited uniformly on the surface of the support web, and thereby, defects such as breakage of the film occur to cause unstable coating of the coating liquid.

As a bar coater capable of solving the problem, a bar coater is conceivable, which has a primary bar disposed on the upstream side along the carrying direction of the support web, a secondary bar disposed on the downstream side of the primary bar, and a between-bars liquid reservoir disposed between the primary bar and the secondary bar.

By the bar coater, the problem that various kinds of defects due to the entrained air occur when the carrying speed is high may be solved.

However, even in the bar coater, in the case where the relationship between a coating amount of the coating liquid at the primary bar and a deposit amount of the coating liquid after the strip-shaped body passed through the secondary bar is unsuitable, a problem that a liquid reservoir uniform along the width direction of the support web can not be formed in the between-bars liquid reservoir can also arise. In addition, when the coating amount is too excessive relative to the deposit amount, the liquid reservoir may fluctuate in the width direction of the support web to produce a streak defect, etc.

Further, even in the bar coater, when the coating conditions such as a composition and a supplied amount of the coating liquid and the carrying speed of the web are within a specific range, the coating amount of the plate-making layer forming liquid is not controlled at a constant amount at the time of starting coating, quality failures such as thick coating and bubble streaks can be produced.

As means for preventing the quality failures, a method for setting the number of rotations of the primary bar at the time of starting coating to the lower speed than the normal speed, and a method for inhibiting the occurrence of the thick coating and bubble streaks by setting a smaller amount of coating at the time of starting coating, are conceivable.

However, in the case where those methods are adopted, at the part where the primary bar is rotated at low speed and the part where the coating amount of the coating liquid is small in the planographic printing plate precursor as a product, the product loss increases and the manufacturing cost rises.

The invention is achieved in order to solve the above described problems, and an object thereof is to provide a coating apparatus and a coating method capable of performing coating stably in a broad range of coating conditions and inhibiting the occurrence of the product failures.

In addition, another object of the invention is to provide a bar coater and a coating method capable of inhibiting the occurrence of the product loss at the time of starting coating and cutting back on the coating cost.

SUMMARY OF THE INVENTION

A first aspect of the present invention is to provide a coating apparatus for coating with coating liquid a surface of a strip-shaped body carried in a fixed direction, the apparatus including: a primary bar extending along a width direction of a carrying plane, which is a carrying path of the strip-shaped body; a secondary bar extending in parallel with the primary bar on the downstream side of the primary bar; and a between-bars liquid reservoir disposed between the primary bar and the secondary bar for storing the coating liquid therein at the time of coating of the coating liquid, wherein coating conditions at the primary bar and the secondary bar are set so that the relationship $W_2<W_1$ is formed, where a coating amount of the coating liquid at the primary bar is $W_1$ and a coating amount of the coating liquid after the strip-shaped body has passed through the secondary bar is $W_2$.

In the coating apparatus, the coating liquid applied to the surface of the strip-shaped body with the coating amount $W_1$ at the primary bar is adjusted to the coating amount $W_2$ at the secondary bar so that the relationship $W_2<W_1$ is formed. In other words, the coating liquid excessively applied at the primary bar is scraped off at the secondary bar to be adjusted to the predetermined coating amount $W_2$, and thereby, the uniformly coated surface can be obtained.

Further, at the time of coating of the coating liquid, the coating liquid pools between the primary bar and the secondary bar to form the coating liquid reservoir. Accordingly, entrained air following the strip-shaped body and introduced from the upstream side of the coating apparatus is pushed back toward the upstream direction by the pressure of the coating liquid in the coating liquid reservoir, in other words, the entrained air is cut. Here, since the coating amount at the primary bar is larger than the deposit amount of the coating liquid after the strip-shaped body has passed through the secondary bar, the coating liquid is stably stored between the primary bar and the secondary bar to form the coating liquid reservoir uniform along the width direction of the strip-shaped body. Therefore, even in the case where the carrying speed of the strip-shaped body is increased, a uniformly coated surface can be obtained without occurrence of the shortage of liquid due to the entrained air.

The primary bar and the secondary bar may be smooth bars having smooth surfaces, grooved bars having circumferentially grooved surfaces, and wire bars formed by winding a metal wire having a diameter on the order of 0.05 to 1.5 mm on the surface with predetermined pitches or tightly.

The primary bar and the secondary bar may be rotated in the same direction as the carrying direction of the strip-shaped body, or rotated in the opposite direction to the carrying direction. In the case where the bars are rotated in the same direction as the carrying direction, they may be rotated at the same speed as the carrying speed of the strip-shaped body, or rotated at the different speed from the carrying speed.

As the coating conditions that can be set at the primary bar, the number of rotations of the bar, the area and the form of the groove on the bar surface, the bar surface form defined by the thickness of the wire wounded on the bar surface and the winding pitch thereof, the viscosity of the coating liquid, the carrying speed of the strip-shaped body, and the like can be cited.

In addition, as the coating conditions that can be set at the secondary bar, the bar surface form and the like can be cited.

Examples of the strip-shaped body include abase material having flexibility in the form of continuous strip, and specifically, a base material used for a photosensitive material or a magnetic recording material other than the support web. Examples of the base material include the support web, a base material for photographic film, baryta-coated paper for photographic paper, a base material for audiotape, a base material for video tape, a base material for floppy (R) disc, etc. In addition to these, a metal thin plate used for painted metal plate such as a colored iron plate can be cited.

Examples of the coating liquid include colloid liquid of a photosensitive agent used for forming a photosensitive layer for silver salt photography, magnetic layer forming liquid used for forming a magnetic layer in the magnetic recording material, various kinds of paint used for an undercoating layer, an intermediate coating layer, and an overcoating layer of the painted metal thin plate and the like, other than the plate-making layer forming liquid described in the section of "Description of the Related Art".

A second aspect of the invention is to provide a coating apparatus, wherein the coating conditions of the coating liquid at the primary bar and the secondary bar are set so that the relationship $W_2<W_1<1.3\times W_2$ is formed.

In the coating apparatus, since the $W_1$ is not far excessive relative to the $W_2$, the liquid reservoir hardly fluctuates in the width direction of the support web, and thereby, the occurrence of the streak defects can be effectively prevented.

A third aspect of the invention is to provide a coating apparatus, wherein the primary bar is a wire bar formed by winding a wire around a rod, and the coating amount of the coating liquid at the primary bar is set so that the following expression: $W_1=17.4365\times r(2.167\eta+0.289K)/L$ is met by $W_1$, a diameter r (mm) of the wire, the number of rotations K (rpm) of the primary bar, viscosity $\eta$ (cps) of the coating liquid, and the carrying speed L (m/min).

In the coating apparatus, since a wire bar is used as the primary bar, a large amount of coating liquid can be scraped up and a high coating amount $W_1$ can be obtained. Further, since the coating amount $W_1$ is defined by the relationship between the diameter r (mm) of the wire wounded on the primary bar, the number of rotations K (rpm) of the primary bar, the viscosity $\eta$ (cps) of the coating liquid, and the carrying speed L (m/min), the coating amount of the coating liquid at the primary bar can be set so that the optimum coating amount $W_1$ can be obtained in the relationship between the wire diameter r and the number of rotations K of the primary bar and the coating liquid viscosity $\eta$.

A fourth aspect of the invention is to provide a coating apparatus including an air-liquid interface forming portion for forming an air-liquid interface, which is an interface between the coating liquid and air in the between-bars liquid reservoir at the time of coating.

In the coating apparatus, since a stable coating liquid bead is formed on the upstream side of the secondary bar by forming the air-liquid interface at the between-bars liquid reservoir, even in the case where the strip-shaped body is carried at high speed, or liquid with high viscosity is used as the coating liquid, coating of the coating liquid can be performed stably. Thereby, the occurrence of defects can be prevented further effectively compared to the coating apparatus according to the first aspect of the invention, and examples of the defects include the ripple streaks as a wavelike non-uniform portion that appears in the width direction of the strip-shaped body, and streak form defects that similarly appears in the width direction of the strip-shaped body such as white dropout streaks that occur because the coating liquid is not deposited sufficiently, equal pitch streaks that occur on the front surface of the strip-shaped body thinly with equal pitches, and black unevenness produced because the coating liquid is excessively deposited by the rising of the coating liquid level between the primary bar and the secondary bar.

As the air-liquid interface forming portion, for example, a coating liquid sucking out portion, which will be described later, etc. can be cited.

A fifth aspect of the invention is to provide a coating apparatus, wherein the air-liquid interface forming portion includes a coating liquid sucking out part for sucking out the coating liquid stored in the between-bars liquid reservoir.

In the coating apparatus, by sucking out the coating liquid stored in the between-bars liquid reservoir with the coating liquid sucking out portion, the liquid level of the coating liquid in the between-bars liquid reservoir is lowered to form the air-liquid interface.

A sixth aspect of the invention is to provide a coating apparatus, wherein a primary coating liquid supply flow path for supplying the coating liquid is formed on the upstream side of the primary bar, and the coating liquid sucking out portion is a communicating flow path for allowing communication between the between-bars liquid reservoir and the primary coating liquid supply flow path.

The coating apparatus is an example in which the coating liquid sucking out portion is provided as the air-liquid interface forming portion.

In the coating apparatus, since the sucking out effect caused by the flow of the coating liquid within the primary coating liquid supply flow path is utilized for forming the air-liquid interface within the coating liquid reservoir, the construction is simple, and the operation is assured.

A seventh aspect of the invention is to provide a coating apparatus, wherein the strip-shaped body is a support web for forming a base material of a planographic printing plate precursor, and the coating liquid is plate-making layer forming liquid for forming a plate-making layer of the planographic printing plate precursor.

The coating apparatus is an example in which the coating apparatus of the invention is applied to the manufacture of the planographic printing plate precursor.

According to the coating apparatus, since the grained surface of the support web can be coated uniformly with the plate-making layer forming liquid even in the case where the carrying speed is high, a planographic printing plate precursor having a plate-making layer with high uniformity can be manufactured with high productivity.

A eighth aspect of the invention is to provide a coating method for coating with coating liquid a surface of a strip-shaped body carried in a fixed direction, the method using a coating apparatus including: a primary bar extending along a width direction of a carrying plane, which is a carrying path of the strip-shaped body; a secondary bar extending in parallel with the primary bar on the downstream side of the primary bar; and a between-bars liquid reservoir disposed between the primary bar and the secondary bar for storing the coating liquid therein at the time of coating of the coating liquid, coating with the coating liquid at the primary bar and regulating a coating amount of the coating liquid at the secondary bar so that the relationship $W_2<W_1$ is formed, where a coating amount of the coating liquid at the primary bar is $W_1$ and a coating amount of the coating liquid after the strip-shaped body has passed through the secondary bar is $W_2$.

For the same reason as that described in the first aspect of the invention, according to the coating method, even in the case where the carrying speed of the strip-shaped body is increased, a uniformly coated surface can be obtained without occurrence of the shortage of liquid due to the entrained air.

A ninth aspect of the invention is to provide a coating apparatus for coating with coating liquid a surface of a strip-shaped body carried in a fixed direction, the apparatus including: a primary bar extending along a width direction of a carrying plane, which is a carrying path of the strip-shaped body; and a secondary bar extending in parallel with the primary bar on the downstream side of the primary bar, wherein the secondary bar is formed so as to contact the strip-shaped body before the primary bar at the time of starting coating.

In the coating apparatus, at the time of starting coating, the secondary bar contacts the strip-shaped body and then, the primary bar contacts the strip-shaped body. Therefore, in the case where the coating is started when the primary bar contacts the strip-shaped body, since the secondary bar has been already in a state in contact with the strip-shaped body, the coating amount of the coating liquid applied by the primary bar is controlled by the secondary bar. In addition, even in the case where thick coating or bubble streaks occur at the primary bar, since the thick coating and the bubble streaks are eliminated by the secondary bar, occurrence of the product loss at the time of starting coating can be kept to the minimum.

The primary bar and the secondary bar may be smooth bars having smooth surfaces, grooved bars having circumferentially grooved surfaces, and wire bars formed by winding a metal wire having a diameter on the order of 0.1 mm on the surface with predetermined pitches or tightly.

The primary bar and the secondary bar may be rotated in the same direction as the carrying direction of the strip-shaped body, or rotated in the opposite direction to the carrying direction. In the case where the bars are rotated in the same direction as the carrying direction, they may be rotated at the same speed as the carrying speed of the strip-shaped body, or rotated at the different speed from the carrying speed.

Examples of the strip-shaped body include a base material having flexibility in the form of continuous strip, and specifically, a base material used for a photosensitive material or a magnetic recording material other than the support web described in the section of "Description of the Related Art". Examples of the base material include the support web, a base material for photographic film, baryta-coated paper for photographic paper, a base material for audiotape, a base material for video tape, a base material for a floppy (R) disc, etc. In addition to these, a metal thin plate used for painted metal plate such as a colored iron plate can be cited.

Examples of the coating liquid include colloid liquid of a photosensitive agent used for forming a photosensitive layer for silver salt photography, magnetic layer forming liquid used for forming a magnetic layer in the magnetic recording material, various kinds of paint used for an undercoating layer, an intermediate coating layer, and an overcoating layer of the painted metal thin plate, other than the plate-making layer forming liquid described in the section of "Description of the Related Art".

A tenth aspect of the invention is to provide a coating apparatus, wherein the primary bar and the secondary bar approach the strip-shaped body from standby positions separated from the carrying plane at the same approaching speed $V_c$ at the time of starting coating, and the primary bar and the secondary bar are disposed so that a distance a from the primary bar to the carrying plane is longer than a distance b from the secondary bar to the strip-shaped body in the standby positions.

In the coating apparatus, at the time of starting coating, the primary bar moves by the distance a, and the secondary bar moves by the distance b from the standby positions by the time when they contacts the strip-shaped body. Here, since the distance b is smaller than the distance a, and both the primary bar and the secondary bar approach the strip-shaped body at the approaching speed $V_c$, regarding the period from the standby position to contact the strip-shaped body, the secondary bar takes shorter time than the primary bar.

The coating apparatus can be constructed by disposing the primary bar and the secondary bar lower than the carrying plane, which is the carrying path of the strip-shaped body, and providing a suitable elevator lower than the backup member that holds the primary bar and the secondary bar from below. Therefore, the apparatus has an advantage that the construction becomes simple.

An eleventh aspect of the invention is to provide a coating apparatus, wherein the primary bar and the secondary bar move toward the strip-shaped body from the standby positions at the approaching speed $V_c$ such that the relational expression $c/V_c \leqq d/V_w$ is met by a distance difference c, an approaching speed $V_c$, the carrying speed $V_w$, and a distance d at the time of starting coating, where the carrying speed of the strip-shaped body is $V_w$, the center distance as a distance between the center axes of the primary bar and the secondary bar is d, and the difference between the distance a and the distance b is c.

The coating apparatus is an example in which the distance a, the distance b, the approaching speed $V_c$, the carrying speed $V_w$, and the distance d are set as described above in the coating apparatus according to the tenth aspect of the invention.

The center distance d of the primary bar and the secondary bar is equal to the distance that the strip-shaped body travels from when the body contacts the primary bar by the time when the body contacts the secondary bar.

Here, in the coating apparatus, since the relation $c/V_c \leqq d/V_w$ is satisfied, the period from the time when the strip-shaped body contacts the primary bar by the time when the body contacts the secondary bar is shorter than the period from the time when a point on the strip-shaped body passes above the primary bar by the time when the point on the strip-shaped body contacts the secondary bar.

Therefore, the product loss produced during the period from the time when the strip-shaped body contacts the primary bar by the time when the body contacts the secondary bar can be kept to the minimum.

A twelfth aspect of the invention is to provide a coating apparatus further including a primary support roller located on the upstream side of the primary bar in relation to the carrying direction of the strip-shaped body for pressing the strip- shaped body against the primary bar at the time of coating of the coating liquid, and a secondary support roller located on the downstream side of the secondary bar in relation to the carrying direction of the strip-shaped body for pressing the strip-shaped body against the secondary bar at the time of coating, wherein the primary support roller and the secondary support roller are located in positions where the distance b from the secondary bar to the carrying plane becomes smaller than the distance a from the primary bar to the carrying plane in the standby positions, and move toward pressing positions where the strip-shaped body is pressed against the primary bar and the secondary bar at the same speed at the time of starting coating.

In the coating apparatus, the primary bar and the secondary bar contact the strip-shaped body by the movement of the primary support roller and the secondary support roller toward the primary bar and the secondary bar in the state in which the strip-shaped body is wrapped around the rollers. In addition, since the distance b from the secondary bar to the carrying plane is smaller than the distance a from the primary bar to the carrying plane, the secondary support roller approaches the secondary bar before the primary support roller approaches the primary bar. Thereby, the secondary bar contacts the strip-shaped body before the primary bar.

Therefore, in the coating apparatus, at the time of starting coating, since there is no need to raise the primary bar and the secondary bar by raising the backup member toward the strip-shaped body, the backup member can be fixed onto the base of the coating apparatus. By the way, an elevator for moving up and down the backup member may be provided to adjust the contact of the primary bar and the secondary bar with the strip-shaped body.

A thirteenth aspect of the invention is to provide a coating apparatus, wherein a between-bars liquid reservoir is provided between the primary bar and the secondary bar for storing the coating liquid therein at the time of coating of the coating liquid.

The coating apparatus is an example in which the between-bars liquid reservoir is provided in the coating apparatus according to the ninth to twelfth aspects of the invention.

As the carrying speed of the strip-shaped body becomes higher, the amount of the entrained air introduced by accompanying the strip-shaped body also increase, however, in the coating apparatus, since the entrained air is pushed out to the upstream side by the coating liquid pooled in the between-bars liquid reservoir, the defects due to the entrained air hardly occur.

A fourteenth aspect of the invention is to provide a coating apparatus, wherein the strip-shaped body is a support web for forming a base material of a planographic printing plate precursor, and the coating liquid is plate-making layer forming liquid for forming a plate-making layer on the surface of the support web.

The coating apparatus is an example in which the coating apparatus of the present invention is applied to the manufacture of the planographic printing plate precursor. According to the coating apparatus, since the product loss at the time of starting coating of plate-making layer forming liquid to the support web can be kept to the minimum, the manufacturing cost of the planographic printing plate precursor can be reduced.

A fifteenth aspect of the invention is to provide a coating method for coating with coating liquid a surface of a strip-shaped body carried in a fixed direction, the method using a coating apparatus including: a primary bar extending along a width direction of a carrying plane, which is a carrying path of the strip-shaped body; and a secondary bar extending in parallel with the primary bar on the downstream side of the primary bar, wherein the coating is started by bringing the secondary bar into contact with the strip-shaped body before the primary bar.

For the same reason as that described in the ninth aspect of the invention, according to the manufacturing method, the occurrence of the thick coating and the bubble streaks on the coated surface of the strip-shaped body, which is because only the primary bar contacts the strip-shaped body and the secondary bar does not contact the body, can be prevented effectively, and thereby, the occurrence of the product loss at the time of starting coating can be kept to the minimum.

The strip-shaped body, the primary bar, the secondary bar, and the coating liquid are as described in the ninth aspect of the invention.

DETAILED DESCRIPTION OF THE INVENTION

Embodiment 1

Hereinafter, a bar coater as an example of a coating apparatus of the present invention will be described.

Figure 1:
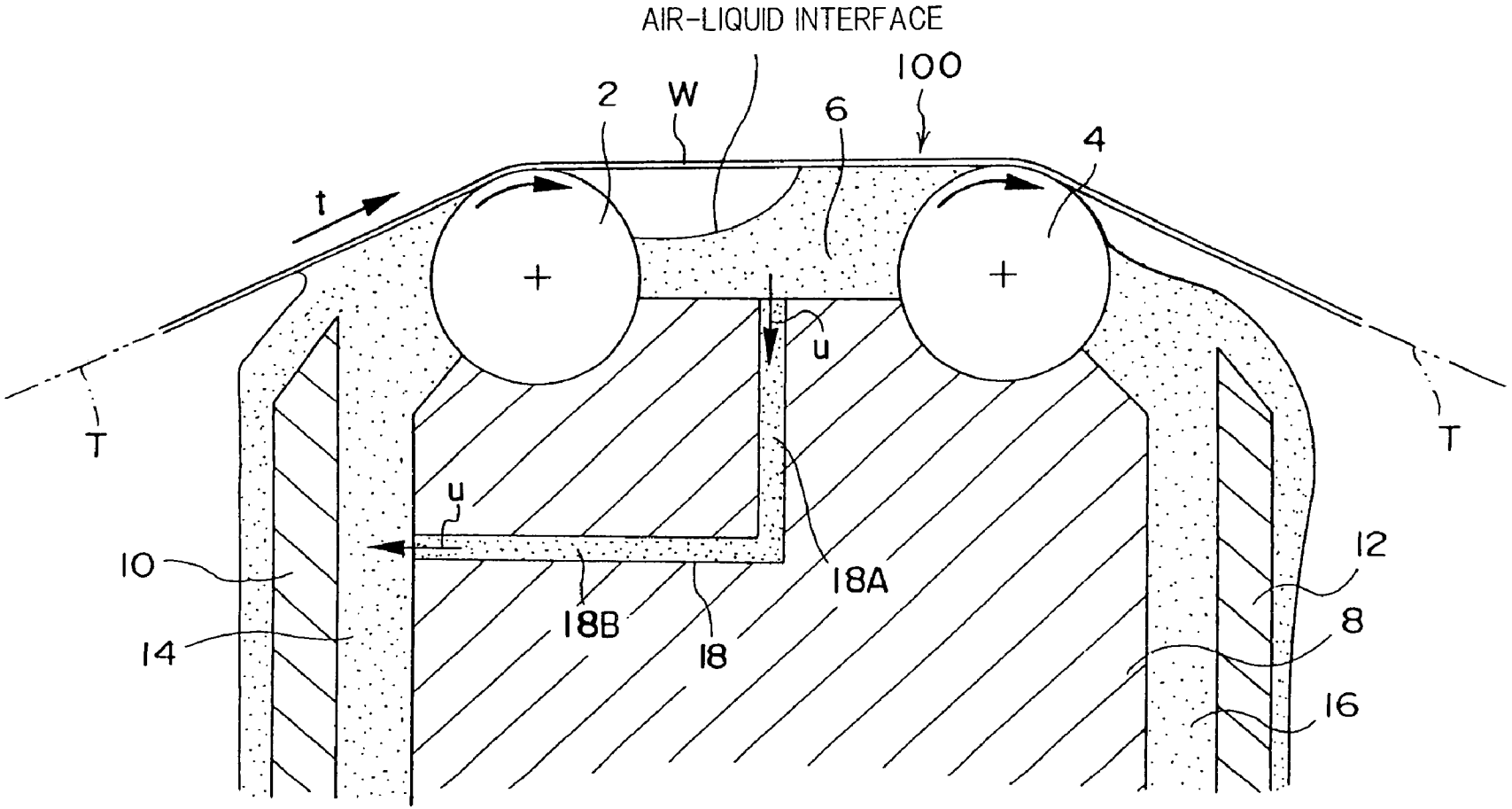
FIG. 1 is a sectional view showing a construction of a bar coater according to a first embodiment of the present invention.
Figure 2:
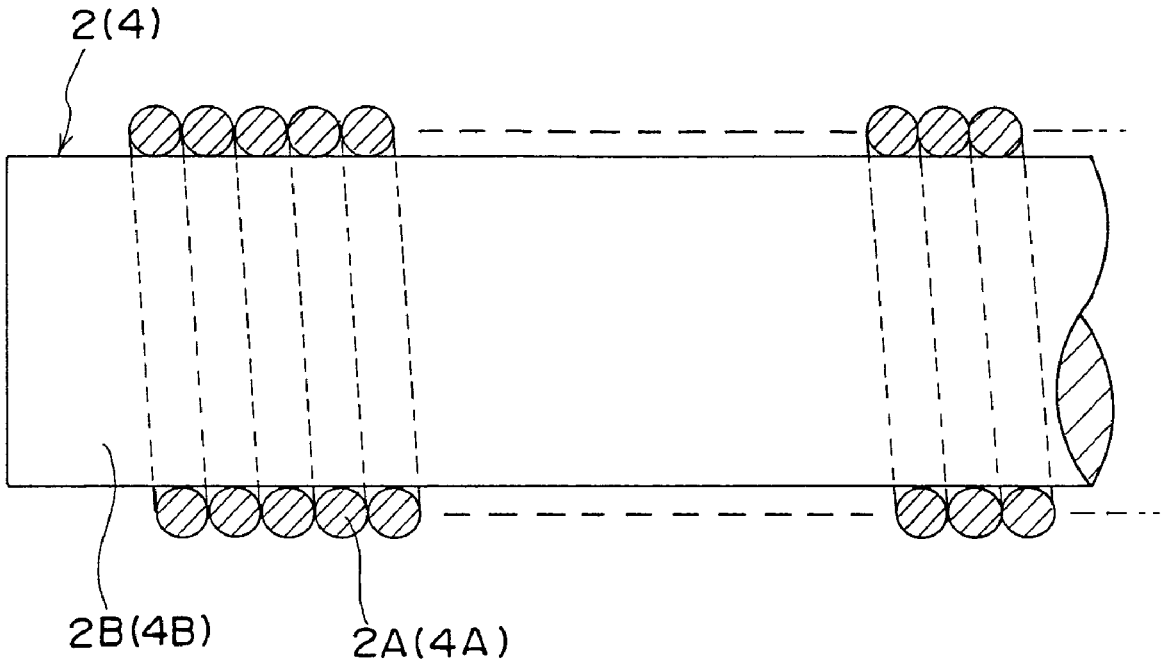
FIG. 2 is a enlarged view showing a construction of a primary bar and a secondary bar included in the bar coater shown in FIG. 1.

A bar coater 100 according to Embodiment 1 is a coating apparatus for coating, with plate-making layer forming liquid, a roughened surface of a support web W carried along a direction shown by an arrow t as an example of a strip-shaped body in the invention, as shown in FIG. 1.

The bar coater has a primary bar 2 extending along a direction orthogonal to the carrying direction t of the support web W on the carrying plane, which is a carrying path of the strip-shaped body, a secondary bar 4 provided on the downstream side of the primary bar 2 in parallel with and at the same height as the primary bar 2, and a between-bars liquid reservoir 6 located between the primary bar 2 and the secondary bar 4.

Both the primary bar 2 and the secondary bar 4 rotate in the same direction as the carrying direction t seen from the carrying plane T as the carrying path of the support web W.

The primary bar 2 and the secondary bar 4 may be smooth bars, however, wire bars formed by tightly winging a wire 2A (4A) on a surface of a smooth bar 2B (4B) as shown in FIGS. 2 to 5 are preferably used. The diameter of the wire 2A (4A) can be suitably determined depending on the coating conditions, the composition and the viscosity of the coating liquid, etc., and preferably within a range of 0.05 to 1.5 mm.

A distance between the center lines of the primary bar 2 and secondary bar 4 can be suitably determined according to the composition and the viscosity of the plate-making layer forming liquid, however, normally, the distance is determined such that the time between the support web W passing through the primary bar 2 and passing through the secondary bar 4 can be equal to or less than 0.02 seconds.

The primary bar 2 and the secondary bar 4 are supported from below by a backup member 8. The between-bars liquid reservoir 6 is formed on the upper side of the backup member 8.

On the upstream side of the backup member 8, a primary weir member (sheathing board) 10 as an example of a weir member in the invention is vertically provided, and, on the downstream side of the backup member 8, a secondary weir member (sheathing board) 12 is vertically provided. Both the primary weir member 10 and the secondary weir member 12 are provided vertically in parallel with the backup member 8.

A primary supply flow path 14 is formed between the primary weir member 10 and the backup member 8, and a secondary supply flow path 16 is formed between the secondary weir member 12 and the backup member 8. The plate-making layer forming liquid is supplied from below toward the primary bar 2 in the primary supply flow path 14, and supplied from below toward the secondary bar 4 in the secondary supply flow path 16. Note that the plate-making layer forming liquid is independently supplied to the primary supply flow path 14 and the secondary supply flow path 16, respectively.

When the plate-making layer forming liquid deposited on the tip ends of the primary weir member 10 and the secondary weir member 12 is dried, foreign matter like slag is produced, and when the foreign matter adheres to the coated surface of the support web W, surface defects such as a streak defect occur. If the tip ends of the primary weir member 10 and the secondary weir member 12 are constantly kept in a covered state by the plate-making layer forming liquid, the above described drying and following production of foreign matter can be prevented, however, for this purpose, it is necessary to allow the plate-making layer forming liquid to flow downward uniformly across the overall width of the primary weir member 10 and the secondary weir member 12. By setting the straightness of height distribution along the width direction of the primary weir member 10 and the secondary weir member 12 to equal to or less than 0.5 mm per meter, and setting the flow rate of the plate-making layer forming liquid in the primary supply flow path 14 and the secondary supply flow path 16 such that the top portions of the primary weir member 10 and the secondary weir member 12 may be constantly covered by the plate-making layer forming liquid, the plate-making layer forming liquid can be allowed to flow downward uniformly.

In the backup member 8, a communicating flow path 18 for allowing communication between the between-bars liquid reservoir 6 and the primary supply flow path 14 is provided.

Figure 3:
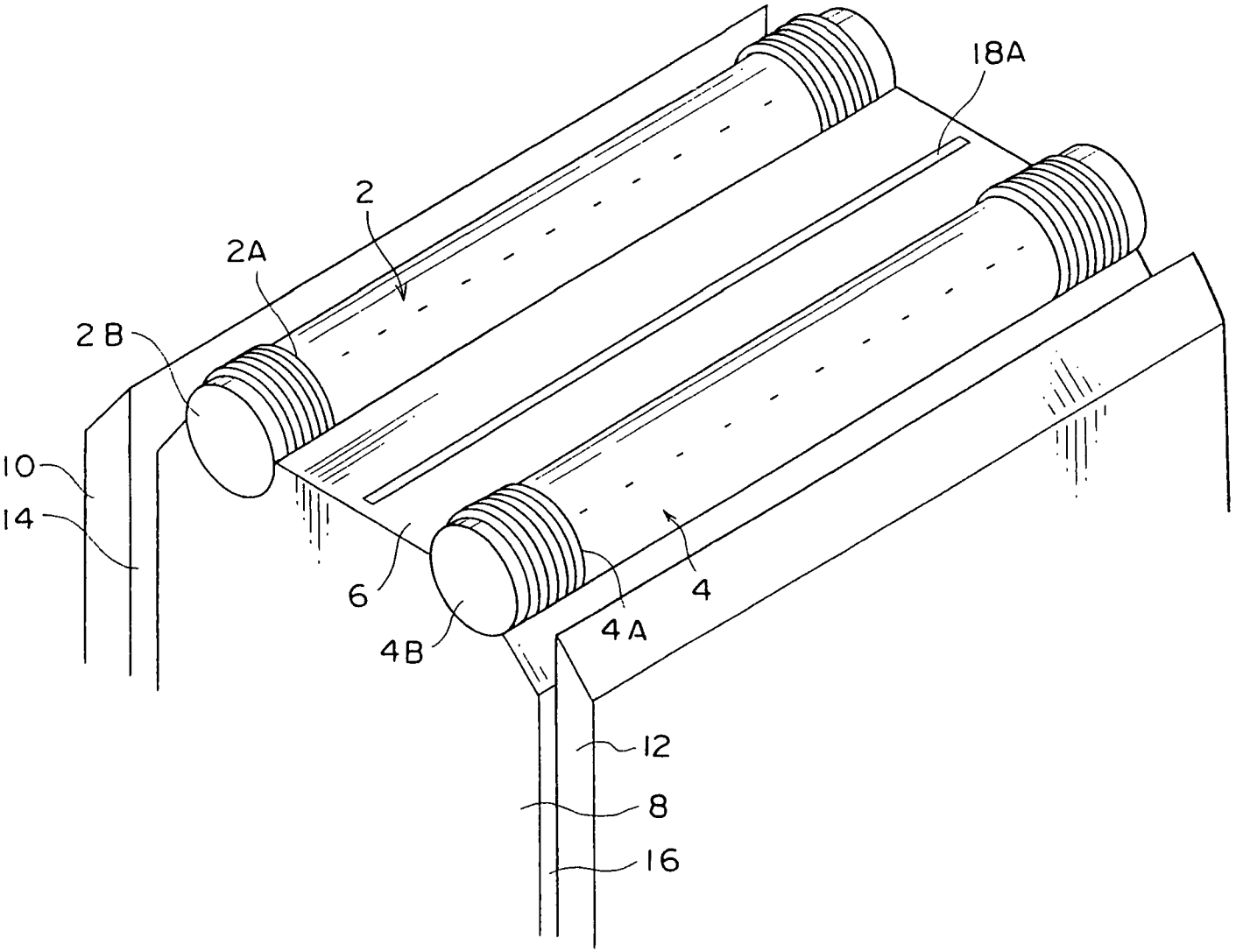
FIG. 3 is a perspective view of the bar coater shown in FIG. 1 seen from an upper oblique direction.

As shown in FIG. 3, the communicating flow path 18 includes a vertical flow path 18A as a flow path that is open in the between-bars liquid reservoir 6 in the form of a continuous slit along a direction substantially orthogonal to the carrying direction t and extends downwardly along the vertical direction from the between-bars liquid reservoir 6, and a horizontal flow path 18B provided in a horizontal direction from the lower end of the vertical flow path 18A to the primary supply flow path 14. The horizontal flow path 18B may be formed in the form of a divided slit that is divided into two or more along the width direction, or may be a flow path constituted by a number of small holes in parallel with each other.

Figure 4:
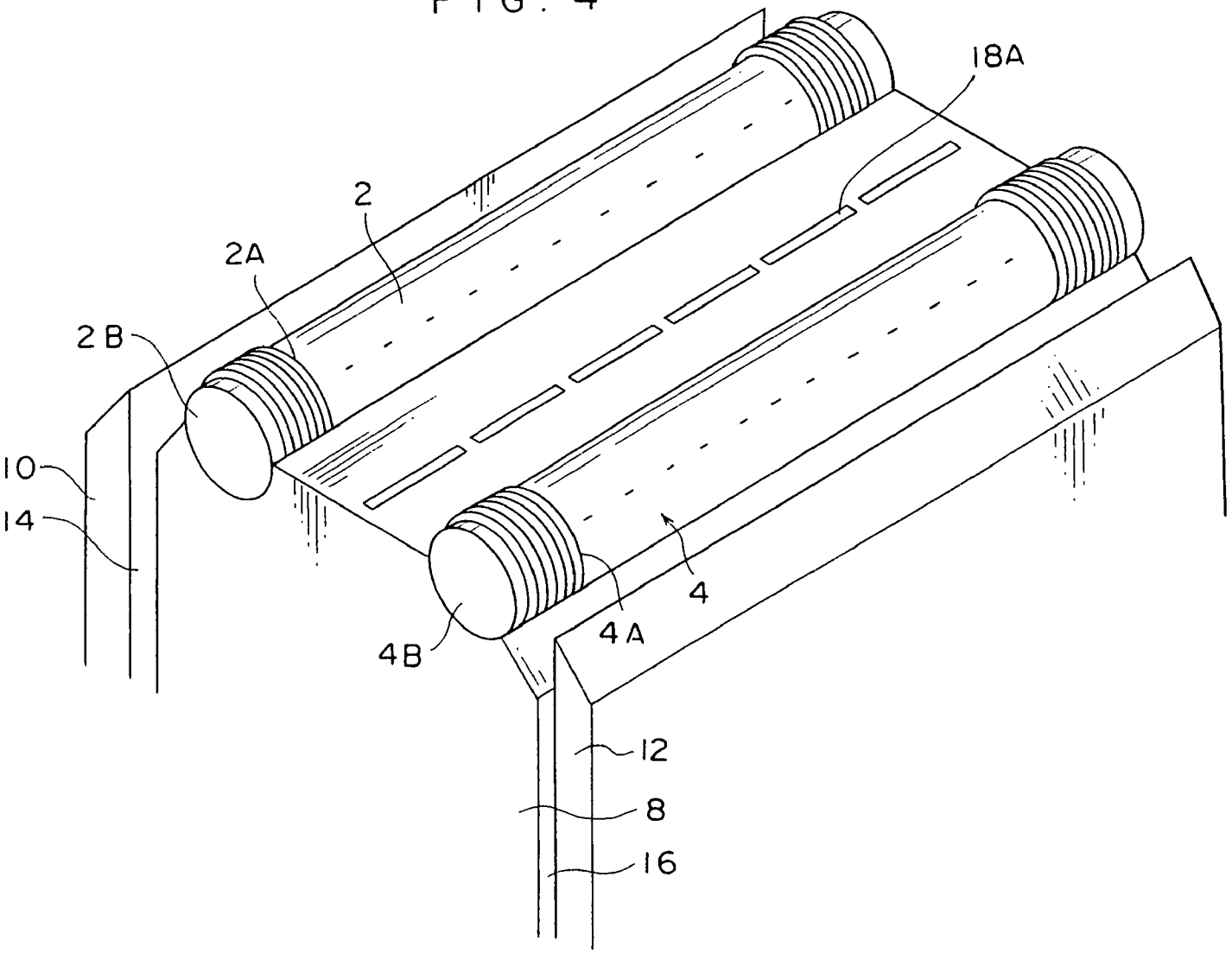
FIG. 4 is a perspective view showing an example in which the bar coater shown in FIG. 1 has a communicating flow path having a different form from that shown in FIG. 1.
Figure 5:
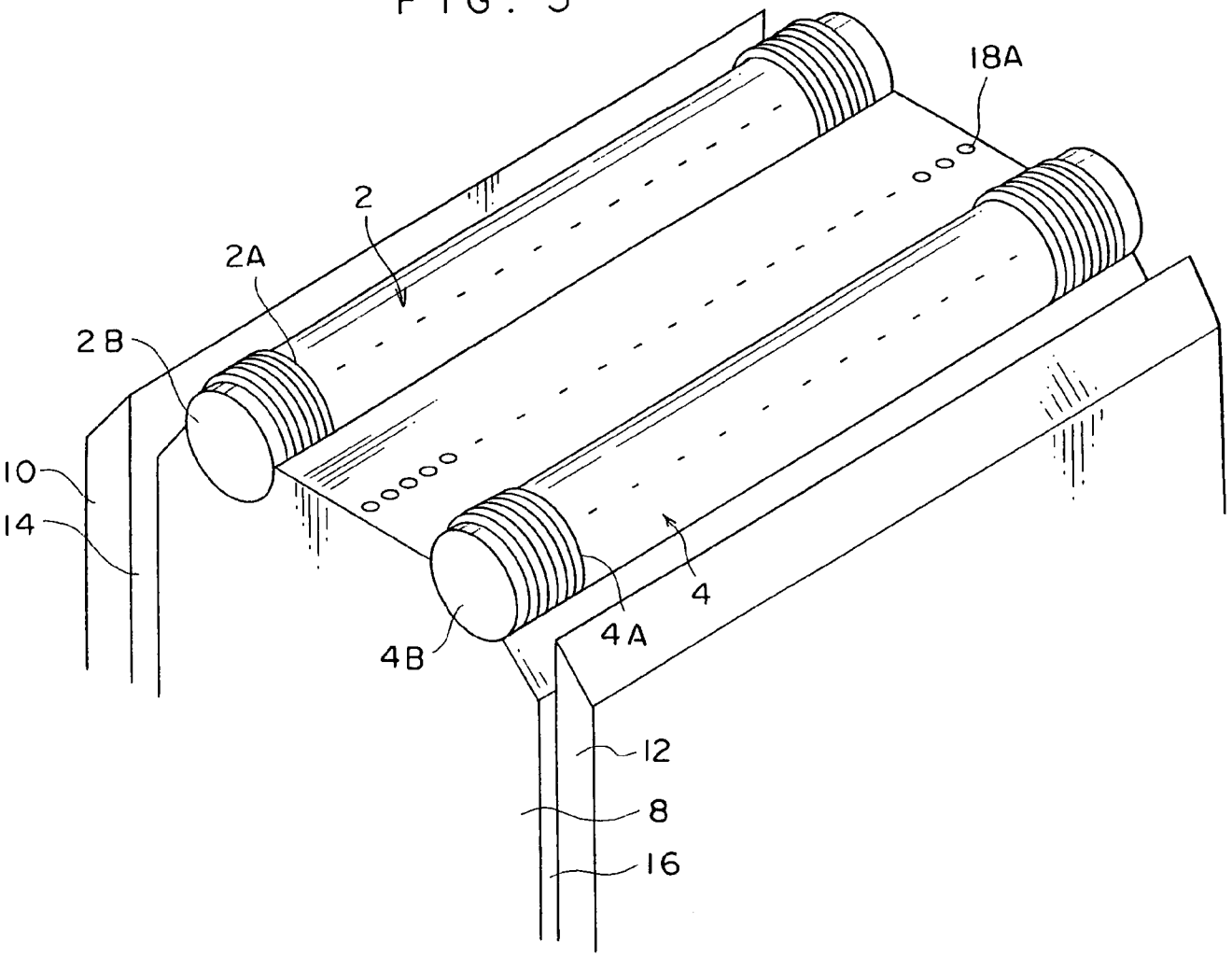
FIG. 5 is a perspective view showing an example in which the bar coater shown in FIG. 1 has a communicating flow path having a different form from those shown in FIGS. 1 and 3.

By the way, the vertical flow path 18A may be open in the form of a divided slit in the between-bars liquid reservoir 6 as shown in FIG. 4, or may have openings in the form of small holes arranged in a row or plural rows as shown in FIG. 5.

The primary weir member 10 is formed so that the top portion thereof is lower than the carrying plane T.

In the bar coater 100, the plate-making layer forming liquid supplied from the primary supply flow path 14 is scraped upwardly by the primary bar 2 and deposited on the roughened surface of the support web W.

A part of the plate-making layer forming liquid is fed toward the downstream side by the primary bar 2 and stored in the between-bars liquid reservoir 6.

The support web W having passed through the primary bar 2 passes through the between-bars liquid reservoir 6.

The support web W having passed through the between-bars liquid reservoir 6 then passes through the secondary bar 4. At the secondary bar 4, the plate-making layer forming liquid applied to the support web W is adjusted to the predetermined coating amount.

To the secondary bar 4, the plate-making layer forming liquid is supplied from the secondary supply flow path 16, and, to the secondary supply flow path 16, the plate-making layer forming liquid is supplied via a flow path independent from that for the primary supply flow path 14.

Here, assuming that the diameter of the wire 2A of the primary bar 2 is r (mm), the number of rotations of the primary bar 2 is K (rpm), the viscosity of the plate-making layer forming liquid is η (cps), and the carrying speed of the support web W is L (m/min), the number of rotations K of the primary bar 2, the viscosity η of the plate-making layer forming liquid, and the carrying speed L of the support web W are set so that the following expressions are held between the coating amount $W_1$ of the plate-making layer forming liquid at the primary bar 2 and the coating amount $W_2$ after the web has passed through the secondary bar 4.

$$W_1=17.4365\times r(2.167\eta+0.289K)/L$$

$$W_2<W_1<1.3W_2$$

Note that the coating amount $W_2$ is a desired coating amount determined by the surface form of the secondary bar 4.

Therefore, in the between-bars liquid reservoir 6, since the plate-making layer forming liquid is stably stored, the coating liquid reservoir is stably formed. Thus, an especially stable bead is formed on the periphery of the secondary bar 4, and thereby, defects caused by the instability of the bead can be effectively prevented.

When the support web W passes through the between-bars liquid reservoir 6, since the entrained air on the surface of the support web W is cut by the coating liquid stored in the between-bars liquid reservoir 6, the defects such as shortage of liquid hardly occur in the coating film.

In the primary supply flow path 14, since the plate-making layer forming liquid circulates upwardly, pressure is reduced at the opening portion of the horizontal flow path 18B on the side of the primary supply flow path 14. Since the horizontal flow path 18B communicates with the between-bars liquid reservoir 6 via the vertical flow path 18A, the plate-making layer forming liquid within the between-bars liquid reservoir 6 flows into the vertical flow path 18A, passes through the horizontal flow path 18B, and flows out into the primary supply flow path 14. Therefore, as shown in FIG. 1 by an arrow u, the flow from the between-bars liquid reservoir 6 through the communicating flow path 18 to the primary supply flow path 14 is produced.

Here, since the height of the primary supply flow path 14 is equal to the height of the primary weir member 10, and the height of the primary weir member 10 is lower than the height of the carrying plane T, i.e., the height of the top portion of the primary bar 2, the liquid level of the between-bars liquid reservoir 6 is lowered to the height of the primary weir member 10, and a space is formed between the liquid level and the support web W. Thereby, an air-liquid interface is formed at the between-bars liquid reservoir 6.

Since the air-liquid interface is formed at the between-bars liquid reservoir 6 as described above, the stable bead of the plate-making layer forming liquid is formed on the upstream side of the secondary bar 4. Accordingly, even in the case where the support web W is carried at high speed, and the plate-making layer forming liquid with high viscosity is supplied from the primary supply flow path 14, a stably coated surface can be obtained without streak defects such as ripple streaks, white dropout streaks, equal pitch streaks, black unevenness.

Embodiment 2

Figure 6:
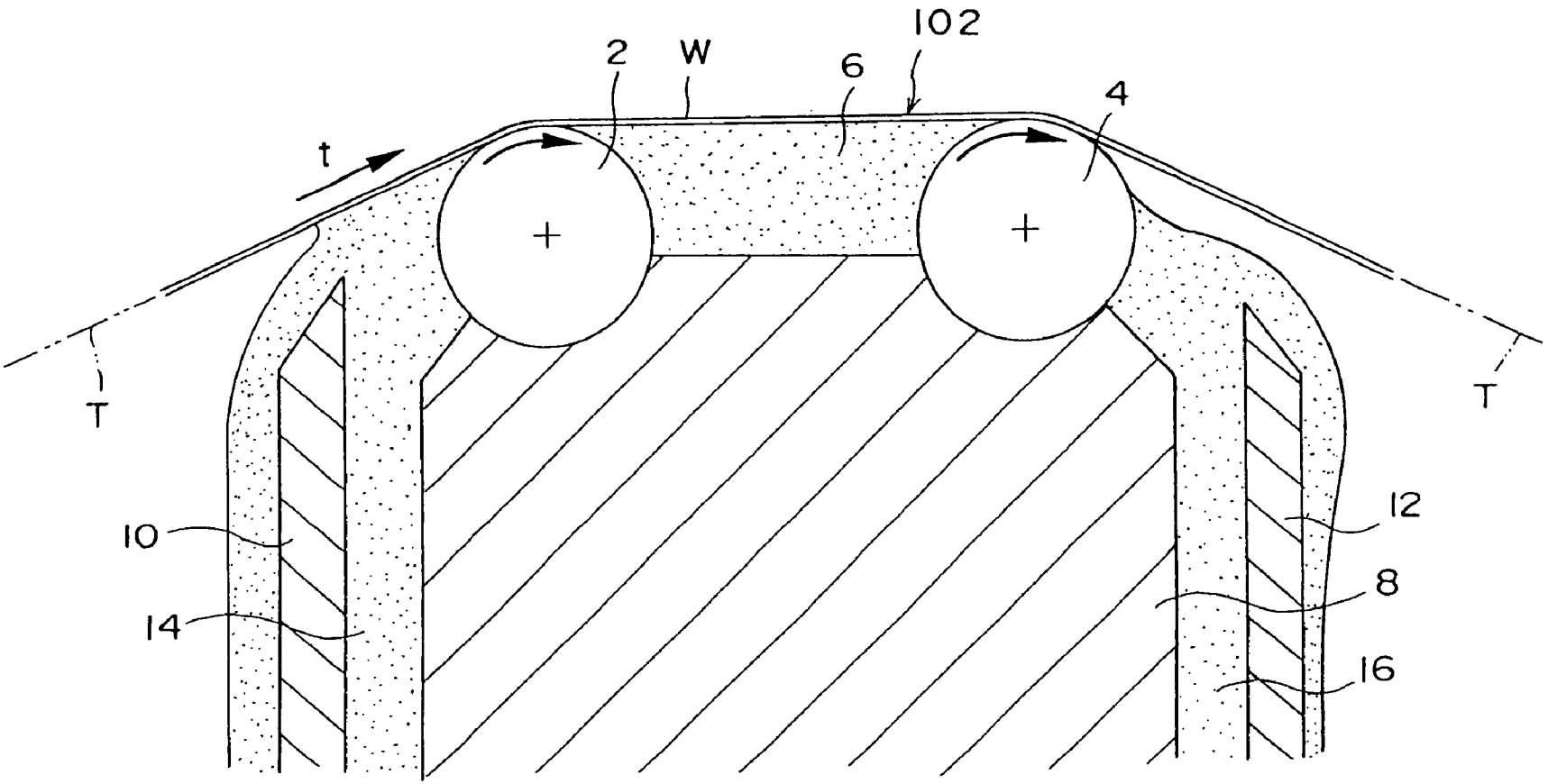
FIG. 6 is a sectional view showing a construction of a bar coater according to a second embodiment of the present invention.

Another example of the coating apparatus according to the invention is shown in FIG. 6. In FIG. 6, the reference numbers and symbols, which are the same as those in FIGS. 1 to 5 indicate the same elements as those in FIGS. 1 to 5.

A bar coater 102 according to Embodiment 2 has a similar construction to the coating apparatus according to Embodiment 1 except that no communicating flow path 18 is provided in the backup member 8, as shown in FIG. 5.

The number of rotations K of the primary bar 2, the viscosity f of the plate-making layer forming liquid, and the carrying speed L of the support web W are set so that the following expressions are held between the diameter r (mm) of the wire 2A, the number of rotations K (rpm) of the primary bar 2, the viscosity η (cps) of the plate-making layer forming liquid, the carrying speed L (m/min) of the support web W, the coating amount $W_1$ of the plate-making layer forming liquid at the primary bar 2, and the coating amount $W_2$ after the web has passed through the secondary bar 4:

$$W_1=17.4365\times r(2.167\eta+0.289K)/L,$$

$$W_2<W_1<1.3W_2.$$

In the bar coater 102, the plate-making layer forming liquid supplied from the primary supply flow path 14 is also scraped upwardly by the primary bar 2 and deposited on the roughened surface of the support web W.

The support web W having passed through the primary bar 2 passes through the between-bars liquid reservoir 6.

The support web W having passed through the between-bars liquid reservoir 6 then passes through the secondary bar 4. At the secondary bar 4, the plate-making layer forming liquid applied to the support web W is adjusted to the predetermined coating amount.

When the support web W passes through the between-bars liquid reservoir 6, since the entrained air on the surface of the support web W is cut by the coating liquid stored in the between-bars liquid reservoir 6, the defects such as shortage of liquid hardly occur in the coating film.

Further, since the communicating flow path is unnecessary to be provided in the backup member 8, the construction can be simplified.

EXAMPLES 1 TO 4, COMPARATIVE EXAMPLE 1

By using the bar coater shown in FIG. 1, the grained surface of the support web is coated with photosensitive layer forming liquid. The coating conditions are as follows.

| | |
|---|---|
| Viscosity of photosensitive layer forming liquid | 8 cp |
| Carrying speed | 120 m/min |
| Support web thickness | 0.3 mm |
| Support web width | 1000 mm |
| Bar coater width | 1600 mm |

The coating of the photosensitive layer forming liquid is performed by setting the flow rate in the primary supply flow path 14 and the secondary supply flow path 16 so that the coating amount $W_1$ at the primary bar 2 and the deposit amount $W_2$ on the downstream side of the secondary bar can be the values shown in Table 1. Then, by visually observing the surface of the obtained planographic printing plate precursor, the number of produced streak defects per 1000 m is counted. The result is shown in Table 1.

TABLE 1

| | $W_2$ (g/m$^2$) | $W_1$ (g/m$^2$) | Number of defects (number of streaks/1000 m) |
|---|---|---|---|
| Comparative Example 1 | 1.5 | 1.4 | Occur on the entire surface |
| Example 1 | 1.5 | 1.6 | 2 |
| Example 2 | 1.5 | 1.8 | 5 |
| Example 3 | 1.5 | 1.9 | 20 |
| Example 4 | 1.5 | 2.0 | 251 |

As shown in Table 1, in Comparative Example 1 where the coating amount $W_1$ is smaller than the deposit amount $W_2$, the streak defects occur on the entire surface of the planographic printing plate precursor, and the number of the produced streak defects per 1000 m can not be counted.

On the other hand, in Examples 1 to 4 where the coating amount $W_1$ is larger than the deposit amount $W_2$, the number of the produced streak defects per 1000 m on the planographic printing plate precursor is 2 to 251, which is smaller than that in Comparative Example 1. Particularly, in Examples 1 to 3 where the coating amount $W_1$ and the deposit amount $W_2$ are in the relationship of $W_2<W_1<1.3\times W_2$, the number of the produced streak defects per 1000 m on the planographic printing plate precursor is especially smaller as 2 to 20.

Embodiment 3

Figure 7:
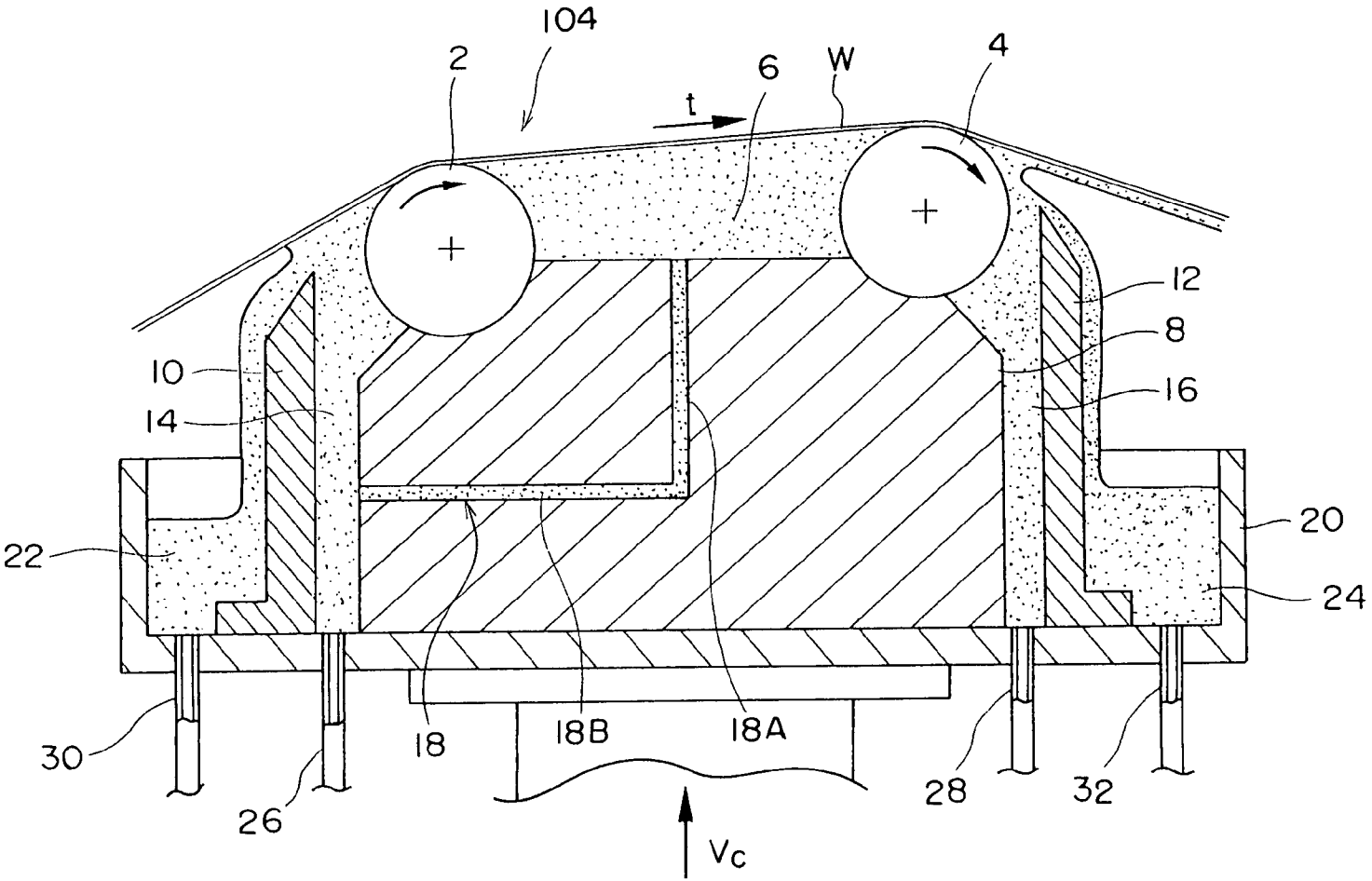
FIG. 7 is a partial sectional view showing a construction of a bar coater according to a third embodiment of the present invention.

A bar coater as an example of the coating apparatus of the invention is shown in FIG. 7. In the description of the embodiment as below, the same reference numbers and symbols are used to indicate the same components as those in Embodiment 1 or the similar components thereto, and the description thereof will be omitted.

In a bar coater 104 according to Embodiment 3, as shown in FIG. 7, the secondary bar 4 is located on the upper position than the primary bar 2.

The primary bar 2 and the secondary bar 4 may be smooth bars, however, wire bars formed by tightly winding a wire on the surface of the smooth bar, and grooved bars having circumferentially grooved surfaces are preferably used. The diameter of the wire 2A (4A) can be suitably determined depending on the coating conditions, the composition and the viscosity of the coating liquid, etc., and preferably within a range of 0.05 to 0.5 mm.

The primary weir member 10 and the secondary weir member 12 are formed so that the top portions thereof are lower than the carrying plane T.

The backup member 8, the primary weir member 10, and the secondary weir member 12 are mounted on a base 20 that can be moved up and down.

The base 20 is in the shallow box shape with the upper part thereof open, and a primary coating liquid storage 22 for storing plate-making layer forming liquid overflowing the primary weir member 10 is provided on the upstream side of the primary weir member 10, and a secondary coating liquid storage 24 for storing plate-making layer forming liquid overflowing the secondary weir member 12 is provided on the downstream side of the secondary weir member 12.

In the base 20, a coating liquid supply line 26 as a conduit for supplying the plate-making layer forming liquid from a plate-making layer forming liquid tank (not shown) to the primary supply flow path 14, and a coating liquid supply line 28 for supplying the plate-making layer forming liquid from the plate-making layer forming liquid tank to the secondary supply flow path 16 are also provided.

In the base 20, a coating liquid return line 30 for returning the plate-making layer forming liquid from the primary coating liquid storage 22 to the plate-making layer forming liquid tank, and a coating liquid return line 32 for returning the plate-making layer forming liquid from the secondary coating liquid storage 24 to the plate-making layer forming liquid tank are also provided.

Hereinafter, the operation of the bar coater 104 will be described.

Figure 8:
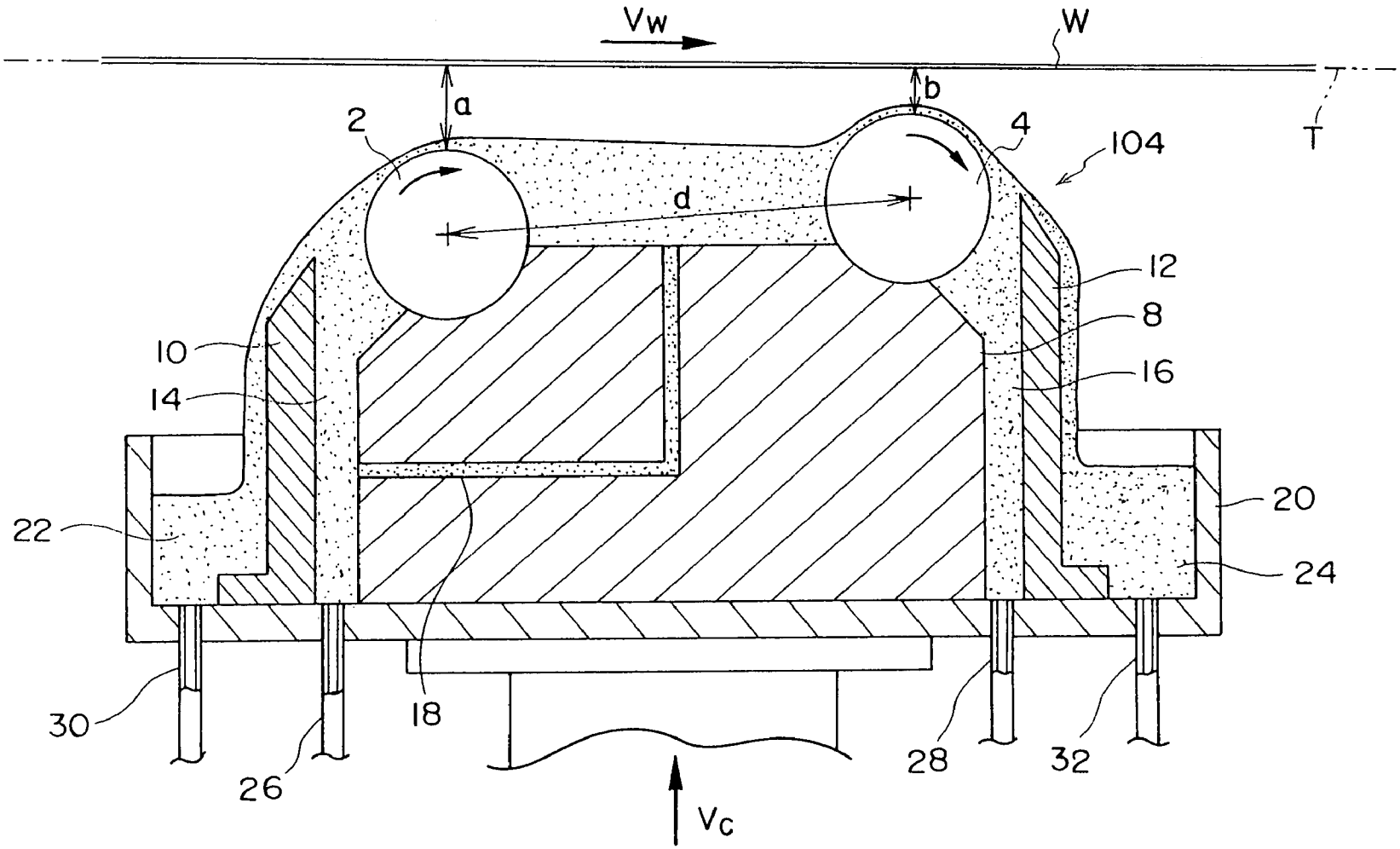
FIG. 8 is a partial sectional view showing the bar coater shown in FIG. 7 in a standby state.

FIG. 8 shows the bar coater 104 in a standby state.

As shown in FIG. 8, when the bar coater 104 is in the standby state, the base 20 is in the most lowered position. Therefore, both the primary bar 2 and the secondary bar 4 are in the standby positions separated from the support web W (or the carrying plane T). Here, the carrying plane T serves as the carrying path of the support web W. In this case, it is assumed that the distance from the primary bar 2 to the carrying plane T is a, the distance from the secondary bar to the carrying plane T is b, the difference between a and b is c, and the distance between the center axes of the primary bar 2 and the secondary bar 4 is d.

When starting the coating, the support web W is carried at the carrying speed $V_w$ along the carrying plane T, and the base 20 is raised at a climbing speed $V_c$ while rotating the primary bar 2 and the secondary bar. At this time, the climbing speed $V_c$ of the base 20 is set so that the following relational expression is formed:

$$c/V_c \leqq d/V_w.$$

Figure 9:
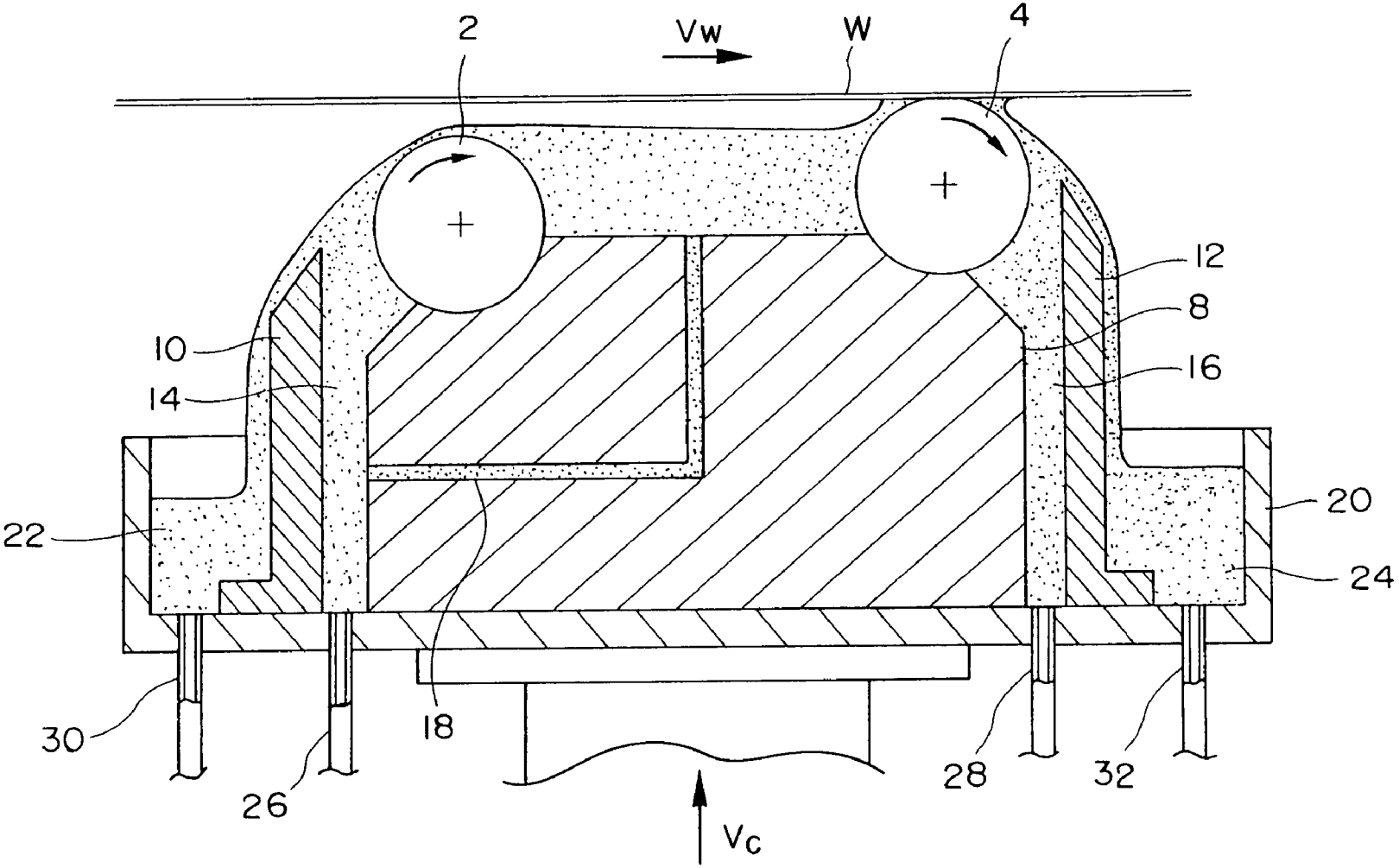
FIG. 9 is a partial sectional view showing transition from the standby state to the operational state in the bar coater shown in FIG. 7.

Since the secondary bar 4 is located in the upper position than the primary bar 2, when the base 20 is raised, as shown in FIG. 9, the secondary bar 4 first contacts the support web W.

When the secondary bar 4 contacts the support web W, the base 20 is further raised, and the primary bar 2 is also made into contact with the support web W as shown in FIG. 7, and thus, the coating with the plate-making layer forming liquid is performed.

The coating is performed similarly to the coating performed by the bar coater 100 according to Embodiment 1.

Of the coating liquid supplied from the primary supply flow path 14 and the secondary supply flow path 16, the liquid that does not adhere to the support web W pools in the between-bars liquid reservoir 6 and forms the coating liquid reservoir. Thus, an especially stable bead is formed on the periphery of the secondary bar 4, and thereby, defects caused by the instability of the bead can be effectively prevented. When the support web W passes through the between-bars liquid reservoir 6, since the entrained air on the surface of the support web W is cut by the coating liquid stored in the between-bars liquid reservoir 6, the defects such as shortage of liquid hardly occur in the coating film.

In the primary supply flow path 14, since the plate-making layer forming liquid circulates upwardly, pressure is reduced at the opening portion of the horizontal flow path 18B on the side of the primary supply flow path 14. Since the horizontal flow path 18B communicates with the between-bars liquid reservoir 6 via the vertical flow path 18A, the plate-making layer forming liquid within the between-bars liquid reservoir 6 flows into the vertical flow path 18A, passes through the horizontal flow path 18B, and flows out into the primary supply flowpath 14. Therefore, the flow from the between-bars liquid reservoir 6 through the communicating flow path 18 to the primary supply flow path 14 is produced.

Here, the height of the primary supply flow path 14 is equal to the height of the primary weir member 10, and the height of the primary weir member 10 is lower than the height of the carrying plane T, i.e., the height of the top portion of the primary bar 2, therefore, the liquid level of the between-bars liquid reservoir 6 is lowered to the height of the primary weir member 10, and a space is formed between the liquid level and the support web W. Thereby, an air-liquid interface is formed at the between-bars liquid reservoir 6.

Since the air-liquid interface is formed in the between-bars liquid reservoir 6 as described above, the stable bead of the plate-making layer forming liquid is formed on the upstream side of the secondary bar 4. Accordingly, even in the case where the support web W is carried at high speed, or the plate-making layer forming liquid with high viscosity is supplied from the primary supply flow path 14, a stably coated surface can be obtained without streak defects such as ripple streaks, white dropout streaks, equal pitch streaks, and black unevenness.

Further, at the time of starting coating, since the secondary bar 4 contacts the support web W before the primary bar, the quality failures such as thick coating and bubble streaks hardly occur on the plate-making layer at the time of starting coating.

Embodiment 4

Figure 10:
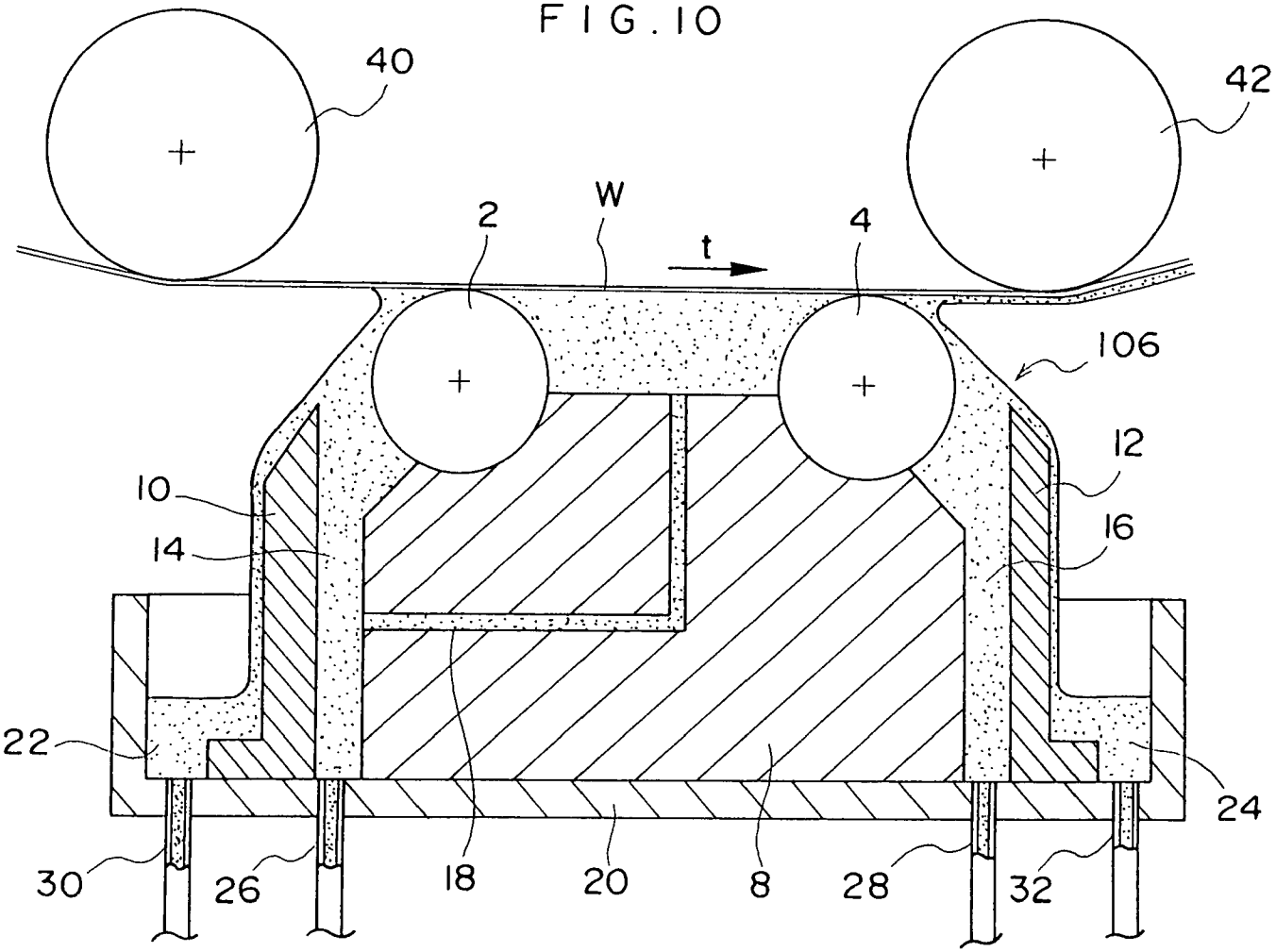
FIG. 10 is a partial sectional view showing a construction of a bar coater according to a fourth embodiment of the present invention.

Another example of the bar coater according to the invention is shown in FIG. 10. In FIG. 10, the reference numbers and symbols, which are the same as those in FIG. 7 indicate the same elements as those in FIG. 7.

As shown in FIG. 10, in a bar coater 106, on the upper side of the primary bar 2 and the secondary bar 4, a primary support roller 40 for pressing the support web W against the primary bar 2 from above, and a secondary support roller 42 for pressing the support web W against the secondary bar 4 from above are provided. The primary support roller 40 is located on the upstream side of the primary bar 2, and the secondary support roller 42 is located on the downstream side of the secondary bar. Both the primary support roller 40 and the secondary support roller 42 are provided movable up and down.

Note that the base 20 is fixed and not movable up or down.

Except for these points, the bar coater 106 is the same as the bar coater 104.

Hereinafter, the operation of the bar coater 106 will be described.

Figure 11:
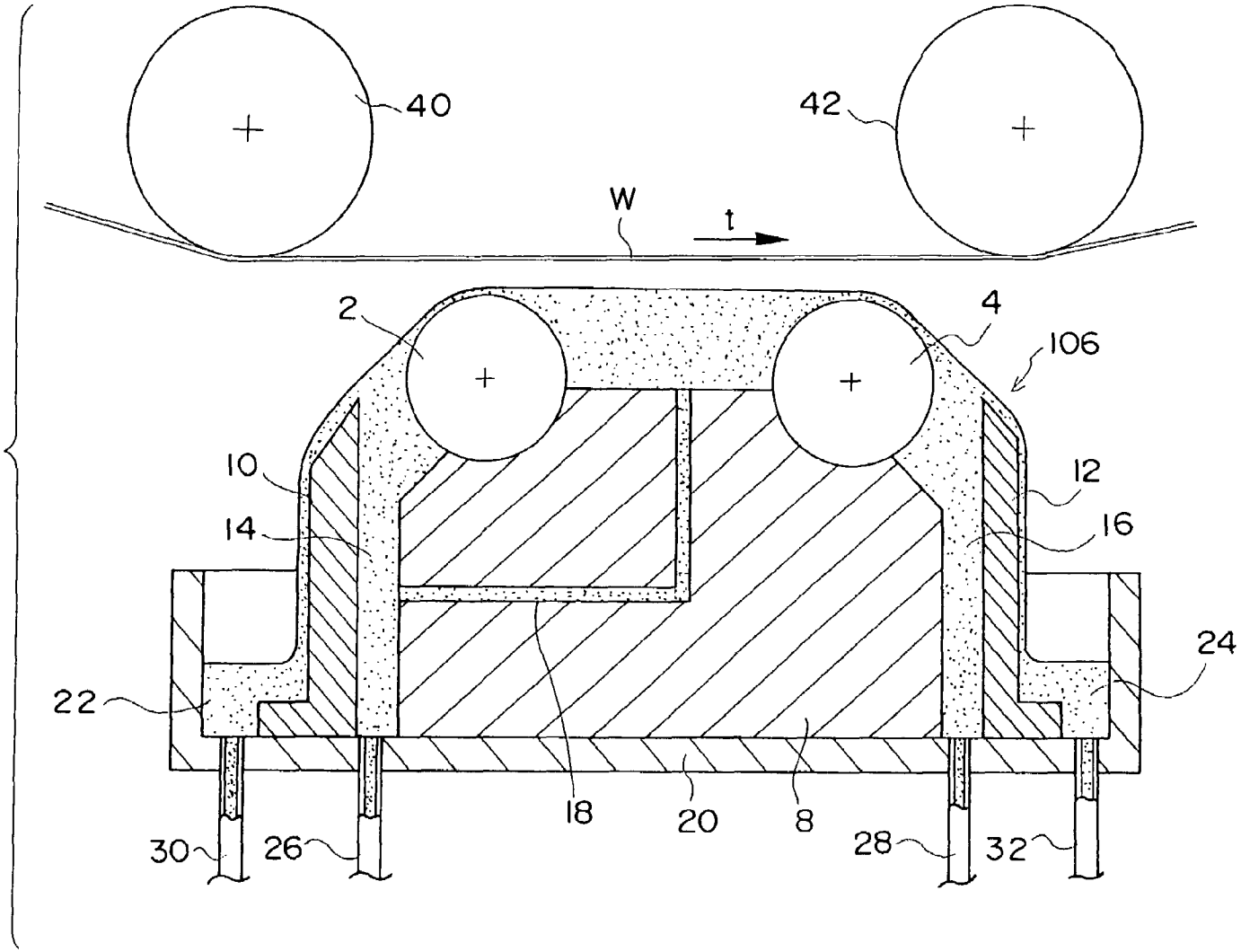
FIG. 11 is a partial sectional view showing the bar coater shown in FIG. 10 in a standby state.

FIG. 11 shows the bar coater 106 in a standby state.

As shown in FIG. 11, when the bar coater 106 is in the standby state, both the primary support roller 40 and the secondary support roller 42 are in the most raised standby positions. Therefore, the support web W is in the separated state from both the primary bar 2 and the secondary bar 4.

Figure 12:
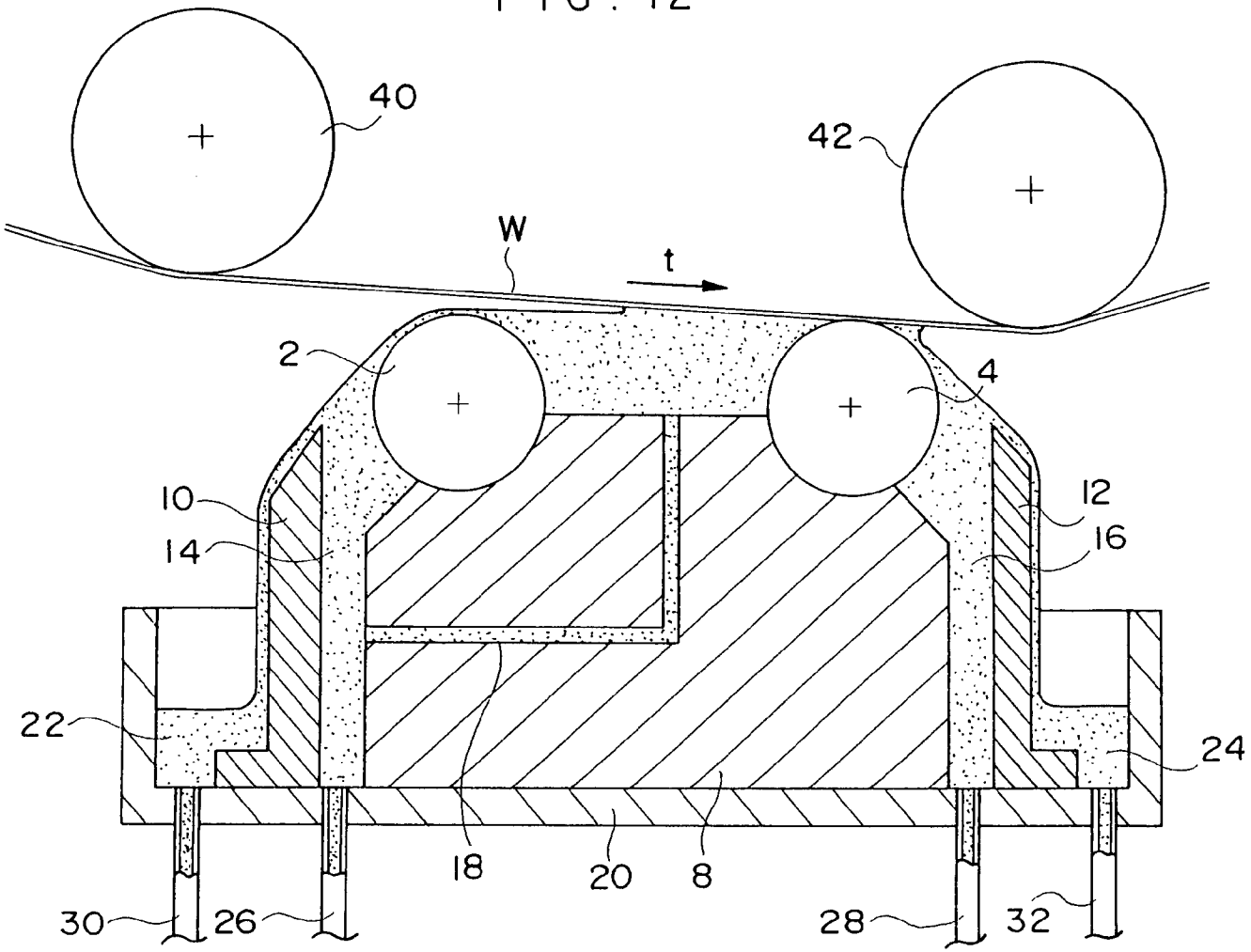
FIG. 12 is a partial sectional view showing transition from the standby state to the operational state in the bar coater shown in FIG. 10.

When starting the coating, while the support web W is being carried, as shown in FIG. 12, the secondary support roller 42 is lowered first and the support web W is made into contact with the secondary bar 4. When the support web W contacts the secondary bar 4, the primary support roller 40 is lowered and the support web W is made into contact with the primary bar 2 and the coating is performed.

The bar coater 106 according to Embodiment 4 has an advantage that the secondary bar 4 is hardly worn earlier than the primary bar 2, since the pressure is equally applied by the support web W to the primary bar 2 and to the secondary bar 4 during coating, in addition to the advantages the bar coater according to Embodiment 3 has.

Embodiment 5

Figure 13:
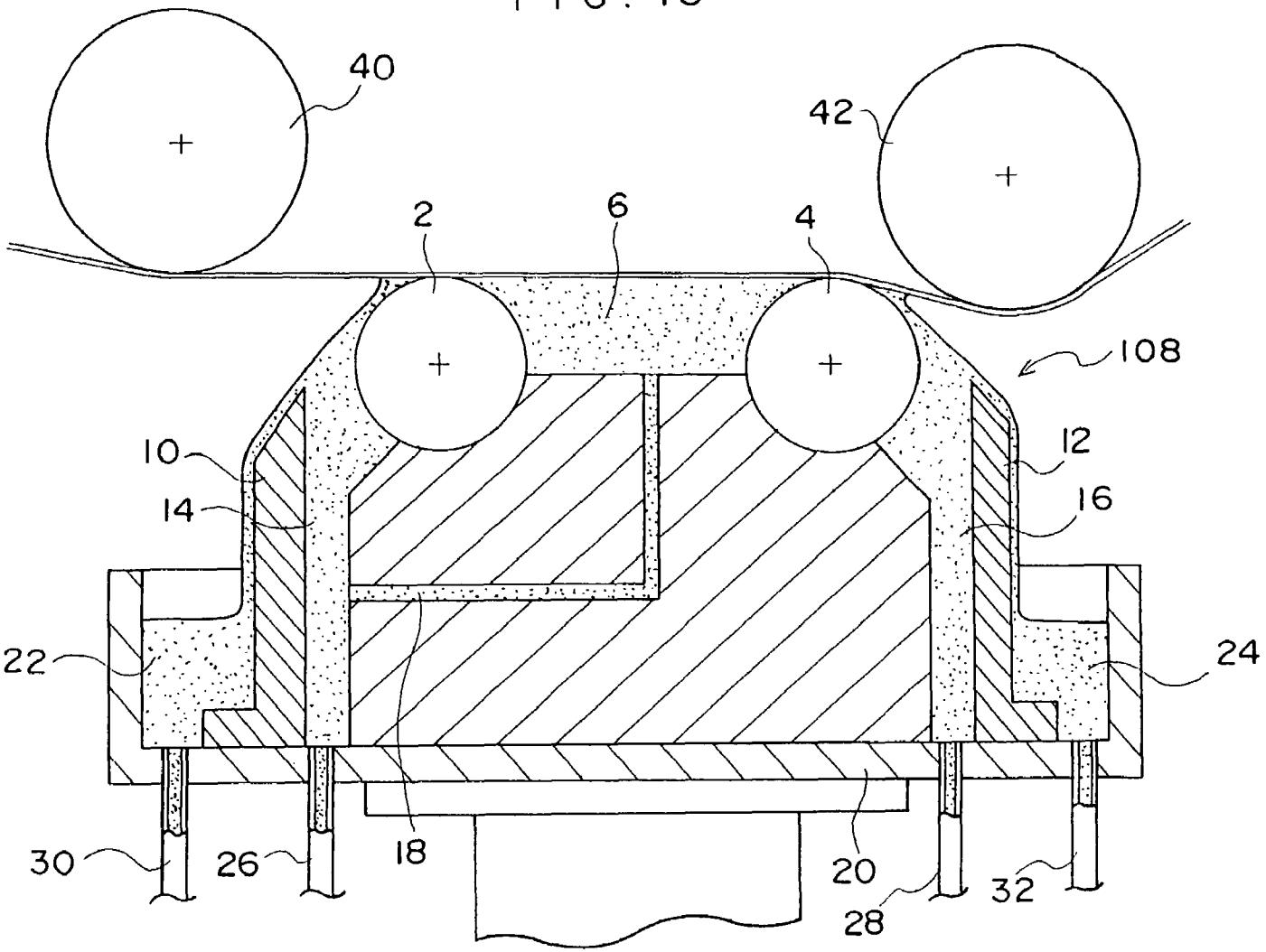
FIG. 13 is a partial sectional view showing a construction of a bar coater according to a fifth embodiment of the present invention.

Still another example of the bar coater according to the invention is shown in FIG. 13. In FIG. 13, the reference numbers and symbols, which are the same as those in FIG. 7 indicate the same elements as those in FIG. 7.

Figure 14:
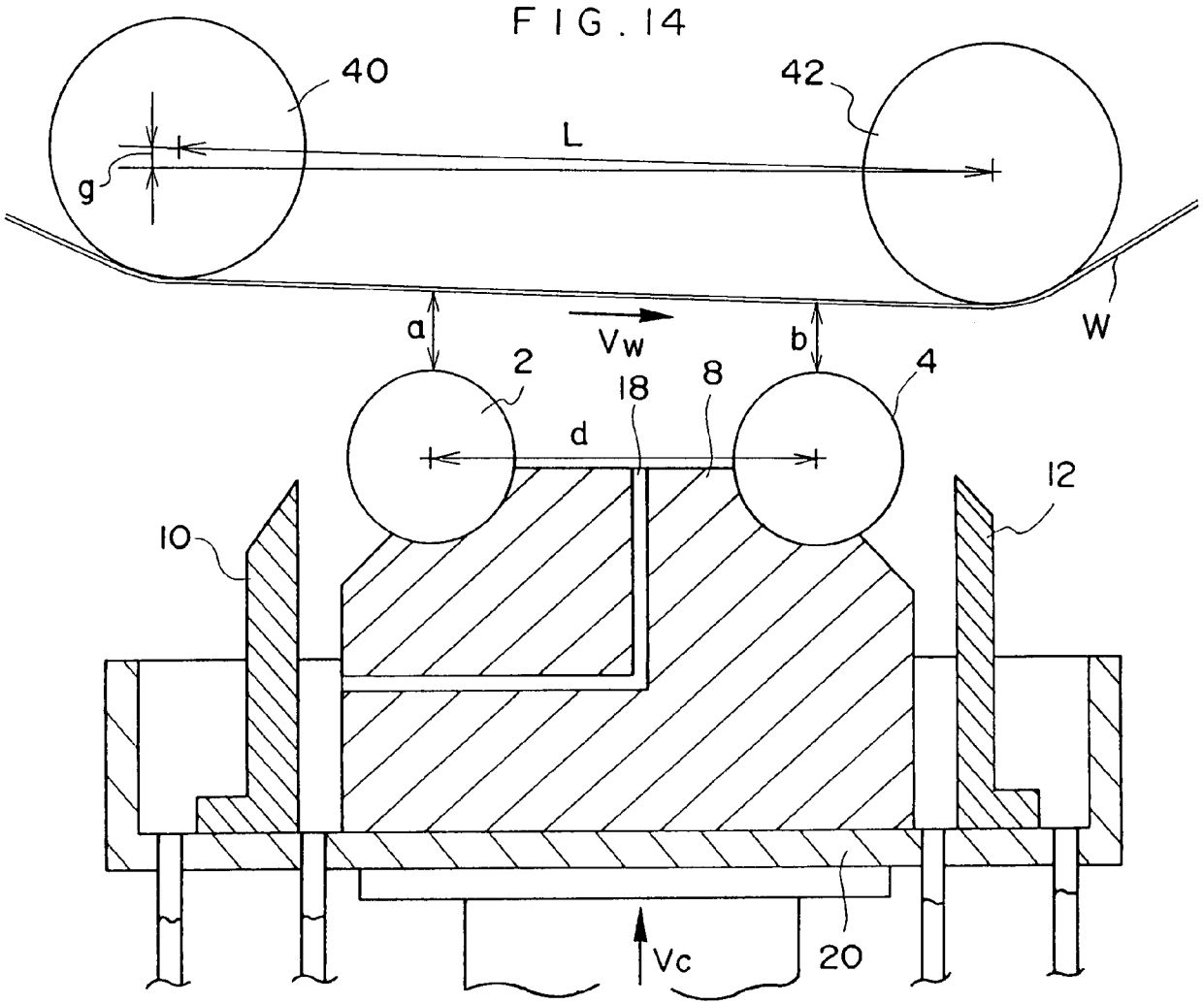
FIG. 14 is a partial sectional view showing the bar coater shown in FIG. 13 in a standby state.

As shown in FIG. 13, in a bar coater 108 according to Embodiment 5, the heights of the primary support roller 40 and the secondary support roller 42 are fixed. Additionally, as shown in FIG. 14, the center axes of the primary support roller 40 and the secondary support roller 42 are separated by a center distance L, and further, the secondary support roller 42 is located in the lower position than the primary support roller 40 by a height difference g. Furthermore, the base 20 is formed so as to be movable up and down, and, when the coating is not performed, as shown in FIG. 14, the base is in the standby position lowered to the lowest position. When the base 20 is in the standby position, the primary bar 2 is in the state separated from the support web W by the distance a, and the secondary bar 4 is in the state separated from the support web W by the distance b. Note that, as described above, since the secondary support roller 42 is lower than the primary support roller 40 in height, the distance b is smaller than the distance a.

At the time of starting coating, the base 20 is raised from the standby position as shown in FIG. 14 to the operating position as shown in FIG. 13. As the base 20 is raised, the secondary bar first contacts the support web W, and then, the primary bar contacts it as shown in FIG. 13. Note that, the climbing speed $V_c$ of the base 20 is set so that the following relational expression is formed.

$$c'/V_c < d/V_w$$

$$(c' = g \times d/L + c,\ c = a - b)$$

Except for these points, the bar coater 108 has the same construction and function as those the bar coater 106 according to Embodiment 4 has.

The bar coater 108 according to Embodiment 5 has an advantage that the construction in the periphery of the primary support roller 40 and the secondary support roller 42 becomes more simple, because the primary support roller 40 and the secondary support roller 42 are unnecessary to be moved up or down, in addition to the advantages the bar coaters according to Embodiments 3 and 4 have.

EXAMPLE 5

By using the bar coater shown in FIG. 7, a grained surface of a support web is coated with a photosensitive layer forming liquid. The coating conditions are as follows.

| | |
|---|---|
| Viscosity of photosensitive layer forming liquid | 10 cp |
| Carrying speed | 120 m/min |
| Center distance d of primary bar 2 and secondary bar | 420 mm |
| Primary bar rotation number | 650 to 750 rpm |
| Coating liquid supplied amount | 5 to 8 liters/min |

By changing the climbing speed $V_c$ of the base 20 as shown in Table 2, occurrence of thick coating and a length of product loss are checked. The result is shown in Table 2.

TABLE 2

| | $c/V_c < d/V_w$ | $c/V_c = d/V_w$ | $c/V_c > d/V_w$ |
|---|---|---|---|
| Thick coating | ○ | Δ | X |
| Product loss | 10 m | 10 m | 60 m |

As shown in Table 2, in the case where the climbing speed $V_c$ is fast and the relationship $c/V_c<d/V_w$ is met by the distance difference c, the center distance d, and the carrying speed $V_w$ of the support web W, thick coating is not found and the product loss remains at 10 m. On the contrary, in the case where the climbing speed $V_c$ is slower and the relationship $c/V_c=d/V_w$ is formed between the distance difference c, the center distance d, and the carrying speed $V_w$ of the support web W, some of thick coating are found, but the product loss remains at 10 m. In the case where the climbing speed $V_c$ is much slower and the relationship between the distance difference c, the center distance d, and the carrying speed $V_w$ of the support web W is $c/V_c>d/V_w$, thick coating is clearly found, and there is the product loss of 60 m.

Note that, it is conceivable that the coating can be started with no thick coating and less product loss when the composition of the photosensitive layer forming liquid and the coating conditions vary, even in the case where there is the relationship $c/V_c \geqq d/V_w$ between the climbing speed $V_c$, the distance difference c, the center distance d, and the carrying speed $V_w$ of the support web W.

What is claimed is:

1. A coating apparatus for coating with coating liquid a surface of a strip-shaped body carried in a fixed direction, the apparatus comprising:

a primary bar extending along a width direction of a carrying plane, which is a carrying path of the strip-shaped body;

a secondary bar extending in parallel with the primary bar and disposed at a downstream side of the primary bar; and a between-bars liquid reservoir disposed between the primary bar and the secondary bar for storing the coating liquid at a time of coating of the coating liquid, wherein coating conditions at the primary bar, which is supplied with the coating liquid by a coating liquid supply flow path, and the secondary bar are set so that the following condition is met, $$W_2<W_1<1.3\times W_2$$

where $W_1$ is a coating amount of the coating liquid that is deposited on the strip-shaped body at the primary bar and $W_2$ is a coating amount of the coating liquid that is deposited on the strip-shaped body after the strip-shaped body has passed the secondary bar, wherein the coating apparatus further comprises a backup member supporting the primary bar and the secondary bar from below, wherein the between-bars liquid reservoir is formed as a space defined by the primary bar, the secondary bar, and the backup member, wherein the coating apparatus further comprises an air-liquid interface forming portion, which is provided at the between-bars liquid reservoir, for forming an air-liquid interface at a time of coating, wherein the air-liquid interface that is formed by the air-liquid interface forming portion is an interface between the coating liquid and air, wherein the air-liquid interface forming portion includes a coating liquid sucking out portion for sucking out the coating liquid stored in the between-bars liquid reservoir.

2. A coating apparatus according to claim 1, wherein the primary bar is a wire bar formed by winding a wire around a rod, and the coating amount of the coating liquid at the primary bar is set so that the following expression $$W_1=17.4365\times r(2.167\eta+0.289K)/L$$

is met by $W_1$, a diameter r (mm) of the wire, a number of rotations K (rpm) of the primary bar, viscosity η (cps) of the coating liquid, and a carrying speed L (m/mm) of the strip-shaped body.

3. A coating apparatus according to claim 1, wherein the coating liquid supply flow path includes a primary coating liquid supply flow path for supplying the coating liquid, which is formed at an upstream side of the primary bar, and the coating liquid sucking out portion is a communicating flow path for allowing communication between the between-bars liquid reservoir and the primary coating liquid supply flow path.

4. A coating apparatus according to claim 1 wherein the strip-shaped body is a support web for forming a base material of a planographic printing plate precursor, and the coating liquid is a plate-making layer forming liquid for forming a plate-making layer of the planographic printing plate precursor.

5. A coating apparatus for coating with coating liquid a surface of a strip-shaped body carried in a fixed direction, the apparatus comprising:

a primary bar extending along a width direction of a carrying plane, which is a carrying path of the strip-shaped body;

a secondary bar extending in parallel with the primary bar and disposed at a downstream side of the primary bar; and a between-bars liquid reservoir disposed between the primary bar and the secondary bar for storing the coating liquid at a time of coating of the coating liquid, wherein coating conditions at the primary bar, which is supplied with the coating liquid by a coating liquid supply flow path, and the secondary bar are set so that the following condition is met, $$W_2<W_1<1.3\times W_2$$

where $W_1$ is a coating amount of the coating liquid that is deposited on the strip-shaped body at the primary bar and $W_2$ is a coating amount of the coating liquid that is deposited on the strip-shaped body after the strip-shaped body has passed the secondary bar, wherein the coating apparatus further comprises a backup member supporting the primary bar and the secondary bar from below, wherein the between-bars liquid reservoir is formed as a space defined by the primary bar, the secondary bar, and the backup member, wherein the coating apparatus further comprises an air-liquid interface forming portion, which is provided at the between-bars liquid reservoir, for forming an air-liquid interface at a time of coating, wherein the air-liquid interface that is formed by the air-liquid interface forming portion is an interface between the coating liquid and air, wherein the air-liquid interface forming portion includes a coating liquid sucking out portion for sucking out the coating liquid stored in the between-bars liquid reservoir, and wherein the primary bar is a bar comprising a wire wound around a rod.

* * * * *